US005973242A

United States Patent [19]

Spezia

[11] Patent Number: 5,973,242

[45] Date of Patent: Oct. 26, 1999

[54] SYSTEM FOR FIXING THE NECK ONTO THE BODY OF STRINGED INSTRUMENTS

[76] Inventor: Raffaele Spezia, Via Toniolo, 15—Tortona, Italy

[21] Appl. No.: 09/182,015

[22] Filed: Oct. 29, 1998

[30] Foreign Application Priority Data

Oct. 31, 1997 [IT] Italy ..... MI97A2451

[51] Int. Cl.[6] ..... G10D 3/00

[52] U.S. Cl. ..... 84/290; 84/291; 84/293

[58] Field of Search ..... 84/290, 291, 293; 411/516, 511, 500, 373, 376

[56] References Cited

U.S. PATENT DOCUMENTS 3,796,464 3/1974 Hansen et al. ..... 299/86

3,831,485 8/1974 Dopera ..... 84/275

4,504,180 3/1985 Ishii et al. ..... 411/5

*Primary Examiner*—William M. Shoop, Jr.

*Assistant Examiner*—Kim Lockett

*Attorney, Agent, or Firm*—Young & Thompson

[57] ABSTRACT

A system for fixing the neck onto the body of a stringed instrument in which the truss-rod (9) of the neck is seated in a corresponding milled portion (8) formed in the body (3) in the region of the foot, the bushes (4) are seated in suitable countersinks (6) formed in the upper side of the neck (2) underneath the fingerboard (1) and are connected to corresponding bushes (11) seated in suitable countersinks (10) formed in the underside of the body of the instrument (3).

21 Claims, 2 Drawing Sheets

SYSTEM FOR FIXING THE NECK ONTO THE BODY OF STRINGED INSTRUMENTS

BACKGROUND OF THE INVENTION

The present invention relates to the construction of stringed instruments, in particular amplified guitars and basses.

More particularly, the present invention relates to a system for fixing the neck to the body of the instrument.

Traditional, so-called solid-body instruments, in particular electric guitars and basses, adopt a system for fixing the neck to the body which uses self-tapping screws and, in most cases, a metal plate positioned underneath the foot of the body opposite the fixing screws. The latter, which are normally four in number, pass through the holes in the metal plate and the foot forming part of the body; they then engage inside the bottom end of the neck, fixing the latter to the body in the seating provided by means of milling.

This system has various drawbacks. The threading in the wood material is often delicate and this results in a limited number of possible maintenance operations involving disassembly and the corresponding overhaul of the neck and body, with the need for adjustment of the position, any varnishing and touch-up work, correction of the relative inclination of the neck and body and other stringed-instrument repair operations. The bonding force between neck and body is directly dependent upon the quality of the woods used in addition to the cross-section of the screws.

This type of construction requires the presence of a strong, but awkward fixing foot which is retained on the body of the instrument. The foot constitutes a further problem, in particular for the musician, who often has difficulty in gaining access to the highest positions on the fingerboard, forcing him to/her to assume unnatural and tiring positions and making it somewhat difficult to play certain sequences of notes at high speed or in particular positions.

An alternative is provided by instruments having the neck mounted in a fixed manner on the body, by means of bonding or a single-body construction. This solution, however, involves technical problems, such as the impossibility of re-positioning the neck should it, with the passing of time, undergo slight variations or adjustments in position, and a timbre—i.e. a response to the vibration frequencies of the instrument—which is different from that of an instrument with a screwed body and neck.

SUMMARY OF THE INVENTION

It has now been discovered that using a bush-type fastening system it is possible, by means of suitable measures, to reduce the thickness and dimensions of the foot supporting the neck, until it becomes an integral part of the neck itself, and therefore fully connect it thereto.

The present invention therefore relates to a system for joining together the neck and body in a stringed instrument comprising a bushing or bush-type fastening system. The invention also relates to a method for construction of a stringed instrument which uses the fastening system described above.

BRIEF DESCRIPTION OF THE DRAWINGS

These and other subjects, such as the instruments constructed in accordance with the invention, will now be described in detail also with the aid of drawings in which:

In FIG. 1 the following numbers indicate the corresponding parts:

1. fingerboard
2. neck
3. foot (neck/body joint)
4. body
5. metal reinforcing plate
6. self-tapping screws

In FIGS. 2 and 3 the following numbers indicate the corresponding parts:

Figure 1:
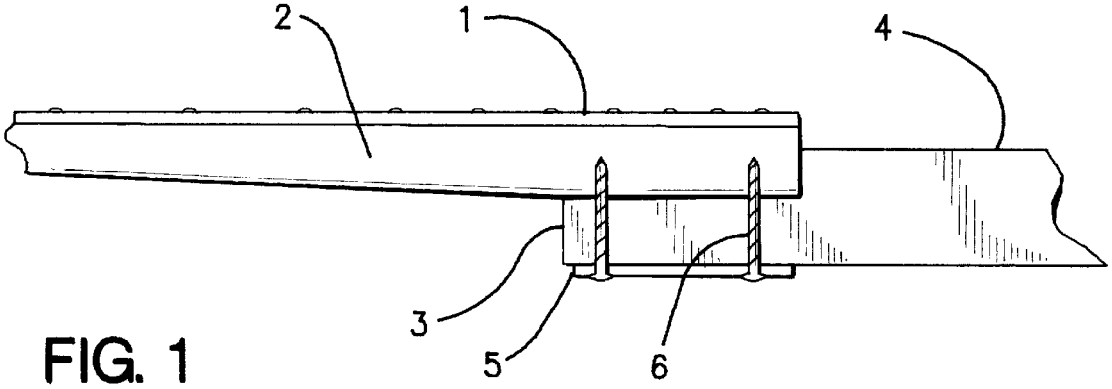
FIG. 1 PRIOR ART
FIG. 1 shows a traditional fastening system consisting of screws of the type self-tapping into the wood in accordance with the known art.

1. fingerboard
2. neck
13. body
14. bushes (brushings) with blind threaded hole
15. stud pins
16. countersinks for seating bushes
7. fixing holes
8. bottom end seating for neck truss-rod
9. top end of neck truss-rod
10. countersink for seating the fixing bushes (11)
11. fixing bushes
17. truss-rod The system according to the present invention overcomes the problems of the known art: in particular, it will be much easier for the musician to reach even the last frets, since the foot is completely joined to the neck, and the thumb and the palm of the left-hand will not encounter any obstacles. The performer will therefore not have to make uncomfortable and unnatural changes in position and fingering when playing the high notes of the instrument.

The musical instrument will retain a timbre which is characteristic of instruments with a screwed neck.

It will be possible to perform a large number of disassembly operations and relative adjustments of the neck and body.

The neck truss-rod will be easily accessible and any replacement thereof will also be possible without damaging the instrument.

The force with which the neck and body are fastened together will be practically independent of the types of wood used and moreover the bonding force of the parts may be calibrated using suitable dynamometer tools in order to obtain the best possible acoustic performance.

DETAILED DESCRIPTION OF THE PREFERRED EMBODIMENTS

Figure 3:
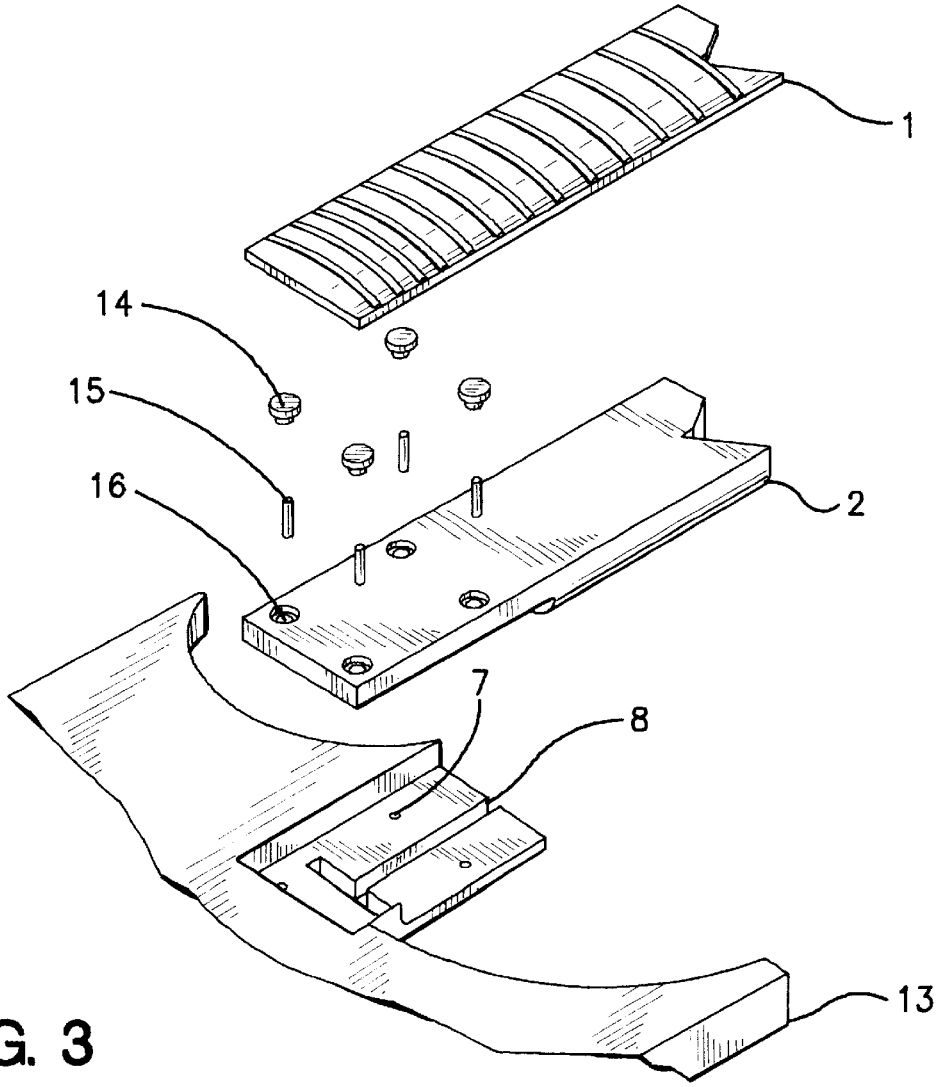
FIG. 3 shows an exploded perspective view, from above, of the fastening system according to an embodiment of the present invention.
Figure 2:
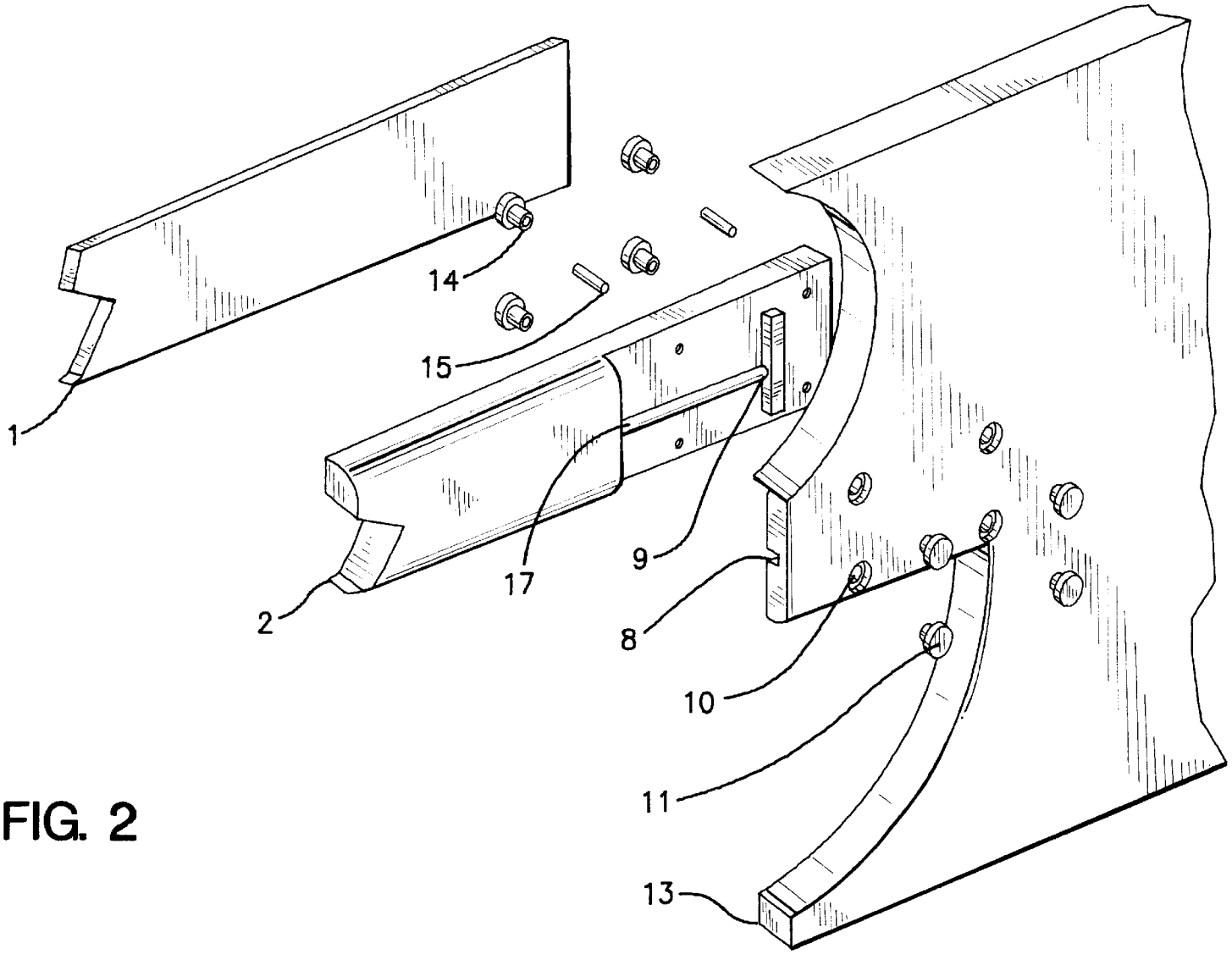
FIG. 2 shows an exploded perspective rear view of the fastening system according to an embodiment of the present invention.

The invention will now be described in detail, in particular with reference to the example of embodiment of FIGS. 2 and 3.

First of all it will be necessary to remove from the neck the portion of material situated underneath the bushes until the bottom end of the truss-rod of the neck (9) is completely exposed.

A milled portion (8) suitable for containing and retaining the end of the truss-rod will be formed in the upper side of the foot; the neck will then be fixed using the system according to the invention.

The foot may then be connected to the neck.

Unlike the traditional systems, the truss-rod will now have a dual function: not only will it correct the curvature which the neck will assume under the tensile strain of the strings, but it will also keep said neck firmly pressed against the front part of the foot, counter-balancing entirely the tension of the strings.

The system according to the invention, in order to confer solidity and reliability over time to the connection between the two parts in question, comprises the insertion into the neck just below the fingerboard, during construction of the instrument, of a number of bushes (74) with a blind threaded hole, equal to the number of fixing points and, obviously, located in alignment with the latter.

After holes (16), which may be countersunk, have been made through the neck, the bushes will have screwed to them stud pins (15) or simple threaded bars with a length calculated so as to protrude from the underside of the neck by the amount needed for fixing to the body of the instrument (3). After holes (7) have been formed on the body of the instrument, opposite the points for fixing of the neck and, if necessary, countersinks (10) of a suitable size and depth have been formed in the underside of the body in the region of said holes, the neck (2) and the body (3) will be fixed by means of the bushes (11) with the fixing threaded through-hole, which, once they have been screwed onto the stud pins inserted into the neck using the system described above, will form a strong and durable system for fastening together the two parts. The abovementioned bushes, which may have been suitably machined beforehand in order receive the tool for performing tightening (e.g. Allen key, crosshead or slotted-head screwdriver), will be concealed inside the abovementioned countersinks formed underneath the body.

A preferred embodiment of the invention in which, by way of example, the bushes are four in number, has been described above.

The invention, however, comprises alternative and equivalent embodiments which are within the competence of the average person skilled in the art.

In particular, by way of an alternative to the bushes (14) and the stud pins (15), it is possible to use bolts provided with a head suitably formed so that it may be inserted into and locked inside the neck and wide enough to ensure good bonding of the parts.

In another possible embodiment, as an alternative to the bushes (14), it is possible to use metal strips, which are preferably corrosion-resistant and in which threaded holes will be formed opposite the fixing points.

In yet another embodiment of the invention, as an alternative to the bushes (11) and the stud pins (15), bolts provided with a head which is suitably formed and is long enough to ensure good bonding of the parts may be used.

The truss-rod, according to the embodiment of the present invention, performs the dual function of correction of the curvature of the neck stressed by tensile force of the strings and engagement of the neck against the front part of the body.

This dual function may also be applied with excellent results also to guitars with a glued neck or stringed instruments which require a similar construction. The present invention also comprises a system for fixing the neck onto the body of the instrument, characterized in that the truss-rod of the neck is seated in a milled portion in the underside of the foot.

I claim:

1. System for fixing a neck onto a body of a stringed instrument, comprising:

a truss-rod formed in the neck;

a milled seating portion in an upper side of a foot, said milled seating portion corresponding to and accepting said truss-rod; and bushings mounted in said neck and offset from said truss-rod, said bushings adapted to accept fastening means extending through said body, said fastening means engaging said bushings so as to fix said neck onto said body, wherein said bushings are four in number.

2. Fixing system according to claim 1, wherein said instrument is a guitar.

3. Fixing system according to claim 2, in which said instrument is an electric guitar.

4. Fixing system according to claim 1, wherein said instrument is a bass.

5. Fixing system according to claim 3, in which said instrument is an electric bass.

6. System for fixing a neck onto a body of a stringed instrument, comprising:

a truss-rod formed in the neck;

a milled seating portion in an upper side of a foot, said milled seating portion corresponding to and accepting said truss-rod; and bushings mounted in said neck offset from said truss-rod, said bushings adapted to accept fastening means extending through said body, said fastening means engaging said bushings so as to fix said neck onto said body.

7. Fixing system according to claim 6, in which the truss-rod of the neck is seated in the corresponding milled portion formed in the body in a region of an upper side of the foot, and the bushings are seated in an upper side of the neck underneath a fingerboard and connected to corresponding bushes on a bottom side of the body of the instrument via holes.

8. Fixing system according to claim 7, in which the bushings are connected to stud pins.

9. Fixing system according to claim 7, in which the bushings have a blind threaded hole.

10. Fixing system according to claim 7, further comprising holes in said body, said holes being countersunk so as to receive fixing bushings in a concealed manner.

11. System according to claim 7, in which the bushings are seated in countersinks.

12. Fixing system according to claim 7, in which said fastening means comprise threaded bars of suitable length.

13. Fixing system according to claim 6, in which the bushings are suitably machined in order to receive a tool used to perform tightening.

14. System for fixing a neck onto a body of a stringed instrument, as described in claim 7, wherein said bushings comprise metal strips which have, formed in them, threaded holes.

15. System for fixing a neck onto a body of a stringed instrument comprising, a truss-rod in the neck;

a milled portion in the body adapted to accept said truss-rod;

a plurality of bolts extending through said body and engaged with nuts so as to fix said neck to said body.

16. Method for fixing a neck to a body of a stringed instrument comprising the steps of:

engaging a truss-rod of the neck into a corresponding seating formed in an upper side of a foot and fixing of the neck to the body of the instrument by means of a plural-point fastening system.

17. Method of claim 16, wherein said fastening system comprises bushings.

18. Method of claim 16, wherein said fastening system comprises bolts.

19. Method of claim 16, wherein said engaging step further comprises the step of gluing of the neck to the body of the instrument.

20. Method of claim 19, wherein said fixing step fixes a guitar neck together with a guitar body.

21. Fixing system according to claim 6, wherein the foot is of the concealed type.

* * * * *